US007350252B2

(12) United States Patent
Telegadis et al.

(10) Patent No.: US 7,350,252 B2
(45) Date of Patent: Apr. 1, 2008

(54) PORTABLE DIAPER CHANGING PAD WITH MEMORY FOAM INSERT

(75) Inventors: Karin Telegadis, Yardley, PA (US); George Telegadis, Yardley, PA (US)

(73) Assignee: Ah-Goo-Baby, LLC, Yardley, PA (US)

( * ) Notice: Subject to any disclaimer, the term of this patent is extended or adjusted under 35 U.S.C. 154(b) by 310 days.

(21) Appl. No.: 11/153,483

(22) Filed: Jun. 15, 2005

(65) Prior Publication Data

US 2006/0282953 A1 Dec. 21, 2006

(51) Int. Cl.
*A47G 9/06* (2006.01)
*A47D 15/00* (2006.01)

(52) U.S. Cl. ..... 5/655; 5/419; 5/420; 5/733; 5/925

(58) Field of Classification Search ..... 5/655, 5/420, 419, 417, 738, 731, 733, 925, 658, 5/740

See application file for complete search history.

(56) References Cited

U.S. PATENT DOCUMENTS 3,489,194 A * 1/1970 Hoover ..... 383/4
4,886,150 A 12/1989 Fitzsimmons
5,473,785 A * 12/1995 Lager et al. ..... 5/655
5,551,109 A * 9/1996 Tingley et al. ..... 5/655
6,298,509 B1 10/2001 Vickers
6,405,394 B1 6/2002 Rosenberg
6,694,552 B1 2/2004 Vickers
6,785,921 B1 9/2004 Conforti
7,065,814 B2 * 6/2006 Rutkowski ..... 5/655
2002/0166172 A1 11/2002 Rosenberg
2004/0211003 A1 10/2004 Stackman et al.
2005/0005361 A1 1/2005 Conforti
2005/0081297 A1 * 4/2005 Woodward et al. ..... 5/655
2005/0204471 A1 * 9/2005 Ruiz ..... 5/420
2005/0278856 A1 * 12/2005 Welch ..... 5/655

* cited by examiner

*Primary Examiner*—Alexander Grosz
(74) *Attorney, Agent, or Firm*—Vedder Price, P.C.

(57) ABSTRACT

A portable diaper changing pad with a memory foam insert. The diaper changing pad comprises a mat with a panel having a body of memory foam as a cushion. The memory foam insert preferably comprises a raised head rest section. In one embodiment, the diaper changing pad further comprises two side section panels which may be folded over the middle panel. When the side section panels are folded over the middle panel, the diaper changing pad may be rolled and securely closed for easy storage and portability. The diaper changing pad preferably has a terry cloth cover. Other preferred embodiments include a nonskid bottom surface, a storage bag, and accessories, such as toys.

17 Claims, 4 Drawing Sheets

PORTABLE DIAPER CHANGING PAD WITH MEMORY FOAM INSERT

BACKGROUND OF THE INVENTION

The present invention relates to a diaper changing pad apparatus, in particular a portable diaper changing pad with a memory foam insert. Other aspects of the invention are met through the use of soft, cloth covers.

A number of diaper changing pads are known in the art. However, one common problem in the prior art is the lack of comfort for the baby or infant placed on the changing pad. For example, the changing pad of U.S. Pat. No. 4,886,150 lacks a comfortable surface. Moreover, no known prior art diaper changing pads utilize both a terry cloth cover and a memory foam insert to maximize the comfort of the baby or infant. Thus, there is a need for such a diaper changing pad.

In addition, other prior art changing pads do not incorporate useful features that would improve the versatility and portability of a changing pad. For example, the changing pad of U.S. Patent Pub. No. 2004/0211003 does not incorporate useful accessories such as toys and baby wipes. The changing pads of U.S. Patent Pub. No. 2004/0211003 and U.S. Pat. No. 6,694,552 do not conveniently roll up for easy transportation and storage. Therefore, there is a need for a comfortable diaper changing pad that incorporates such features.

BRIEF SUMMARY OF THE INVENTION

These needs and others may be met by embodiments of the present invention which is an improved diaper changing pad having a memory foam insert.

In general, the present invention is a diaper changing pad that comprises a mat and a cushion within said mat, said cushion comprising a body of memory foam. The disclosed embodiment of this invention provides a comfortable, portable, water-resistant surface for changing a baby or infant.

A preferred embodiment of the present invention further comprises a mat with several panels that can be folded into a folded position, and rolled and secured into a rolled position in order to provide for maximum portability.

Yet another preferred embodiment of the present invention further comprises a head rest comprising a raised portion or second body of memory foam, to provide additional comfort to the baby or infant on the changing pad. Yet another preferred embodiment of the present invention further comprises accessories, such as toys.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF THE DRAWINGS

The invention will be more readily understood with reference to the accompanying drawings.

DETAILED DESCRIPTION OF THE INVENTION

Figure 1:
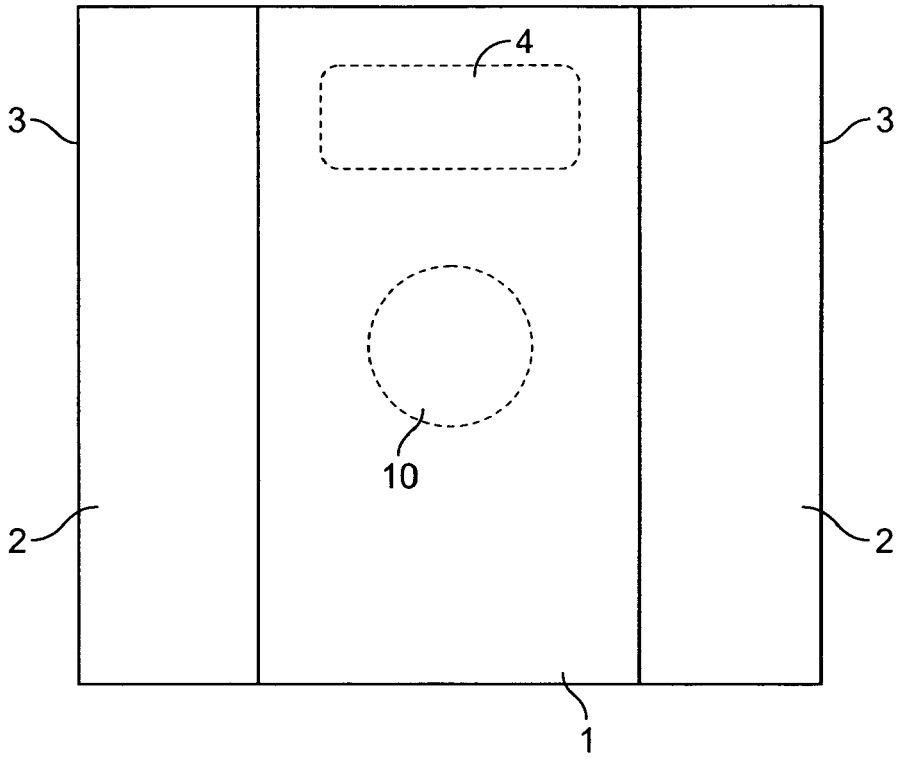
FIG. 1 is a top view of one open embodiment of the diaper changing pad of the present invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrates.

Referring now to the drawings, FIG. 1 shows, generally, a top view of a diaper changing pad that is one example of the present invention. The diaper changing pad comprises a mat having a rectangular middle panel [1] flanked on each side by one of two similar side panels [2], which preferably have a width no more than one half the width of the middle panel [1]. In the preferred embodiment, the middle panel [1] is approximately 10-12 inches wide and approximately 24-28 inches long, which will comfortably accommodate most babies. The middle panel [1], which is preferably made of a soft, comfortable, durable material such as cloth, encloses a body of memory foam [10]. In order to prevent moisture damage to the memory foam [10], the middle panel [1] preferably includes a layer of water-resistant material between the external cloth surface of the middle panel [1] and the body of memory foam [10]. Such water-resistant layer can be a coating applied to the surface of the body of memory foam or a layer connected to the inside surface of the cloth exterior of the middle panel [1].

The middle panel [1] also preferably accommodates a raised head rest section [4] of the memory foam insert, for extra head comfort. The raised head rest may be a raised portion of the memory foam insert [10] or a separate body of memory foam connected to the insert. The raised head rest is described in more detail below in connection with FIG. 3. When changing a baby's diaper, the user preferably places the baby on the middle panel [1], with the baby's head resting on the raised head rest section [4].

The side panels [2] are attached to the middle panel [1] such that they may be folded over the middle panel [1]. Most preferably, the width of the side panels [2] is exactly half of the width of the middle panel [1], so that the outside edges [3] of the side panels [2] meet at the center of the middle panel [1] when the side panels [2] are folded onto the middle panel [1]. The side panels [2], or flaps, are preferably made of thin, comfortable, durable, soft, and sturdy fabric or other material (e.g. terry cloth, fine cotton, or canvas), and may alternatively be lined with a material such as a durable, waterproof plastic.

Figure 2:
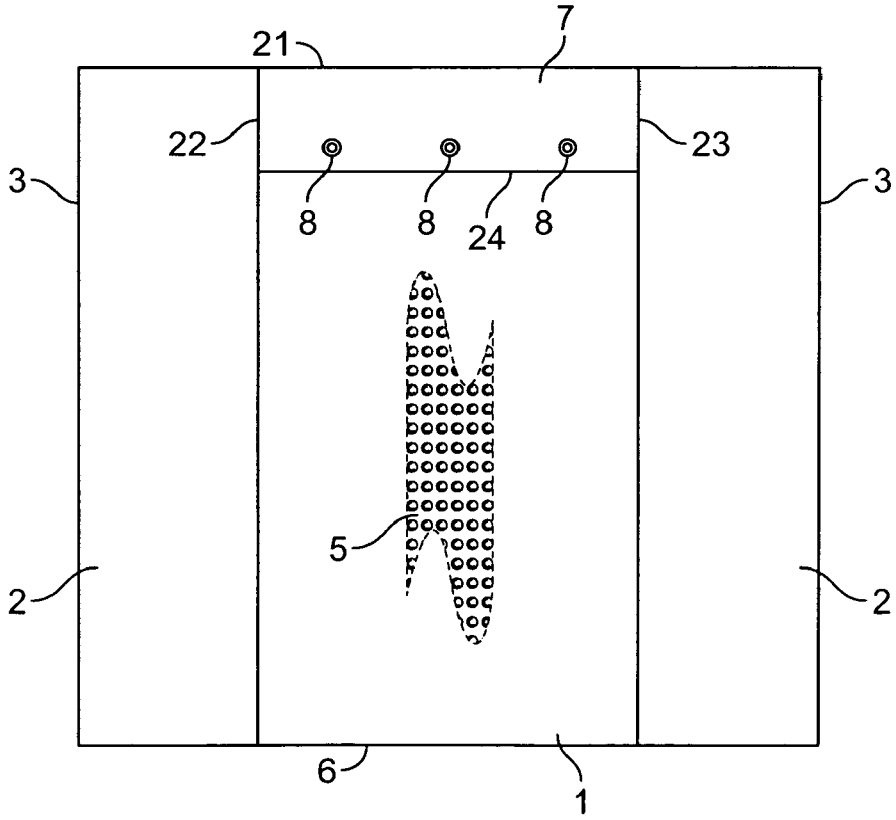
FIG. 2 is a bottom view of one open embodiment of the diaper changing pad of the present invention.

FIG. 2 shows a bottom view of the same open diaper changing pad. The bottom of the middle panel [1] preferably comprises a slide-proof or nonskid surface area [5] such as a pattern or group of rubber nubs. The bottom edge of the middle panel also preferably comprises an opening [6] for inserting and removing the memory foam insert inside the middle panel [1]. The ability to remove the memory foam insert enables the user to clean or replace the memory foam, if necessary. The opening [6] is preferably closed with snaps, but a flap closure or other closure means such as a zipper, buttons, hook and loop fastener, or other conventional means known in the art could also be employed to keep the memory foam insert inside the middle panel [1]. The bottom of the diaper changing pad also preferably comprises a flap [7] (preferably made of a thin, durable fabric or other material such as cloth, mesh, nylon, or spandex) with snaps [8] or some other closure means to secure the diaper changing pad in the closed, rolled position. In one embodiment, the flap [7] is a short (approximately 2-4 inches) section of durable material that is attached to the bottom surface of the middle panel at the top edge [21] and the side edges [22, 23]. The bottom edge [24] of the flap [7] is not attached to the middle panel.

Figure 3:
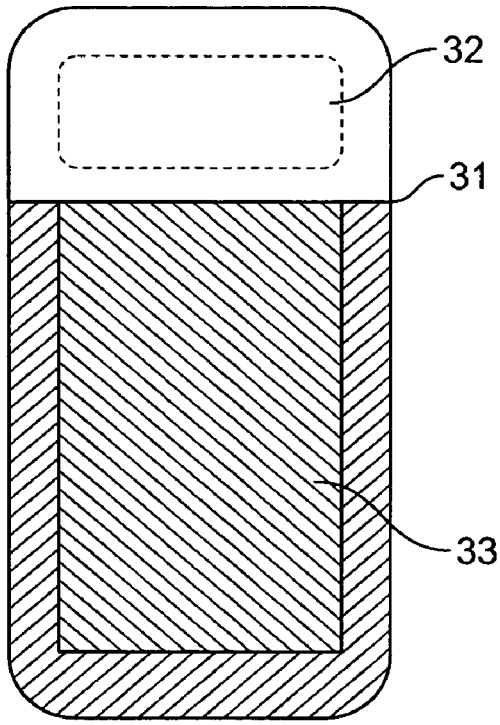
FIG. 3 is a top view of a memory foam insert of one embodiment of the diaper changing pad of the present invention.

FIG. 3 shows a memory foam insert [31], which preferably comprises a body of memory foam (or visco-elastic polyurethane foam) which is most preferably ⅛-½ inch thick. The memory foam insert [31] conforms to the shape of the baby or infant's body and reduced the number of pressure points on the infant. The memory foam insert [31] may be made of any type of memory or visco-elastic foam known in the art. In the preferred embodiment, the memory foam insert comprises a raised head rest section [32] which is most preferably raised ⅛ inch above the main body of the memory foam insert. The raised head rest section [32] may be formed by the same piece of memory foam as the memory foam insert [31] or may be a separate body of piece of memory foam attached to the main body of the memory foam insert [31]. Preferably, the raised head rest section [32] swells or slopes upward from the main body of the memory foam insert [31] to a height of no more than ¼" (most preferably between ⅛" and ¼") above the top surface of the main body of the memory foam insert [31] measured at the middle of the top surface of the raised head rest section [32]. Most preferably, the raised head rest section [32] slopes upward beginning 3 inches from the top and sides of the memory foam insert [31]. In the most preferred embodiment, the raised head rest section [32] is no more than 6 inches in width (from side to side) and 3 inches in length (from top to bottom). Preferably, the memory foam insert [31] is covered with a water-repellant coating [33] to protect the memory foam from moisture and enable the user to easily wipe and clean the memory foam insert. Most preferably, the water-repellant coating [33] covers the entire top surface of the memory foam below 10 inches from the top edge of the memory foam insert.

Figure 4:
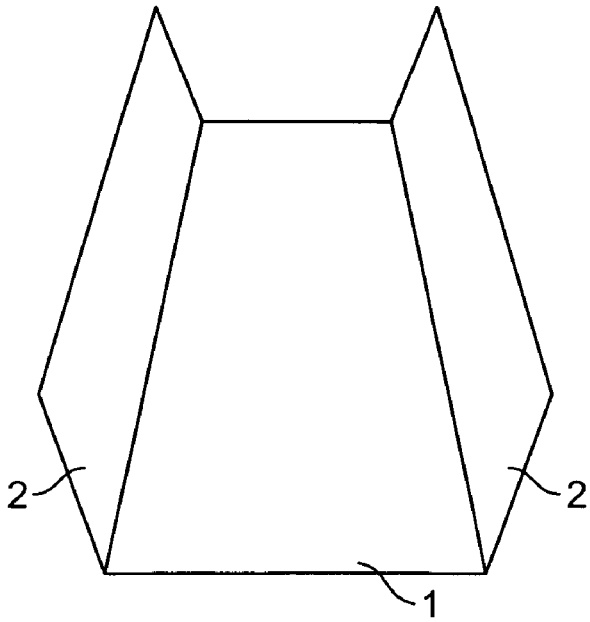
FIG. 4 is a perspective view of one partially-folded embodiment of the diaper changing pad of the present invention.
Figure 5:
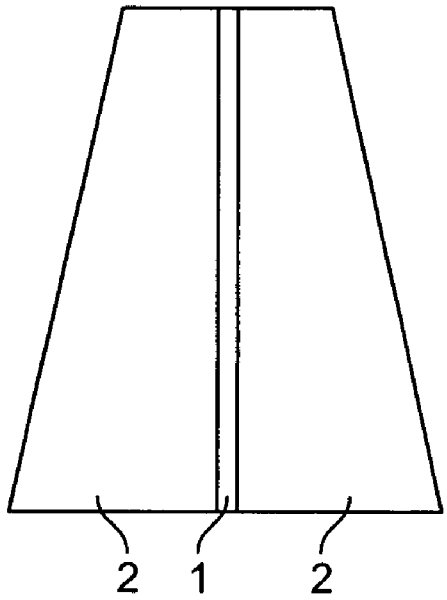
FIG. 5 is a perspective view of one folded embodiment of the diaper changing pad of the present invention.
Figure 6:
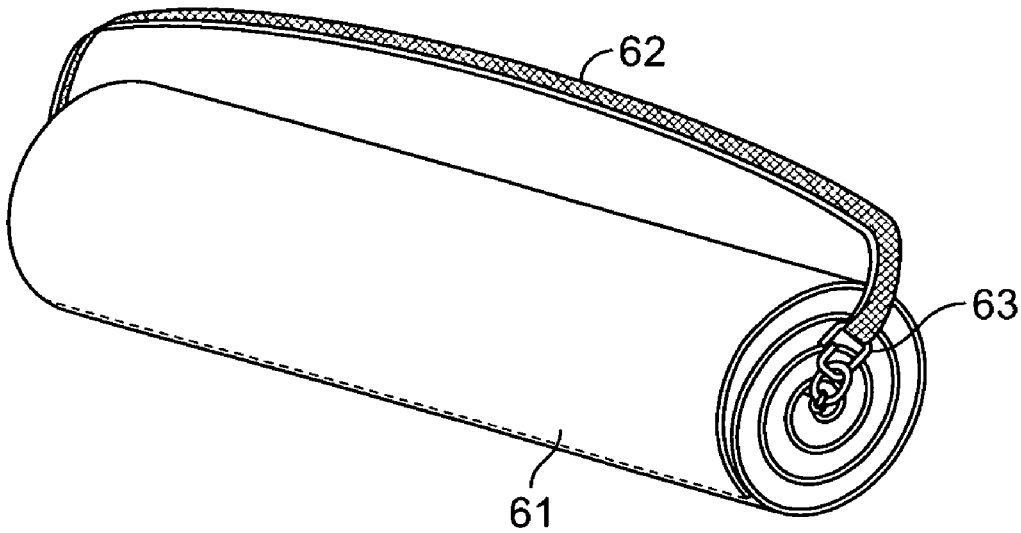
FIG. 6 is a perspective view of one folded, rolled embodiment of the diaper changing pad of the present invention.

FIG. 4, FIG. 5, and FIG. 6 show the same diaper changing pad embodiment in various stages of closure. In FIG. 4, the side panels [2] are partially folded toward the middle panel [1]. In FIG. 5, the side panels [2] are completely folded over the middle panel [1] into a folded position. In FIG. 6, the completely folded diaper changing pad of FIG. 5 has been rolled lengthwise and securely closed with a flap [61] (depicted as part [7] in FIG. 2) in a rolled position. With reference to FIG. 2 and FIG. 6, the bottom edge [24] of the flap [7, 61] secures the diaper changing pad in the rolled position by folding the bottom edge [24] of the flap [7, 61] over and around the top edge [21] of the middle panel in the rolled position, in the manner of a folding plastic sandwich bag. Other suitable means for securing the diaper pad in the rolled position include snaps or other closure means such as a zipper, buttons, hook and loop fastener, or other conventional means known in the art. The portable diaper changing pad is rolled in order to preserve the integrity of the memory foam insert and create a compact and portable assembly. The cylindrical rolled diaper changing pad is preferably approximately 10-12 inches long and 2 inches in diameter, to provide for convenient portability. Preferably, the rolled diaper changing pad may be stored and transported in a bag that is sized to hold the changing pad in the rolled position. The bag preferably has pockets for storing accessories, such as toys, baby wipes, pacifiers, food, and other useful articles.

Figure 8:
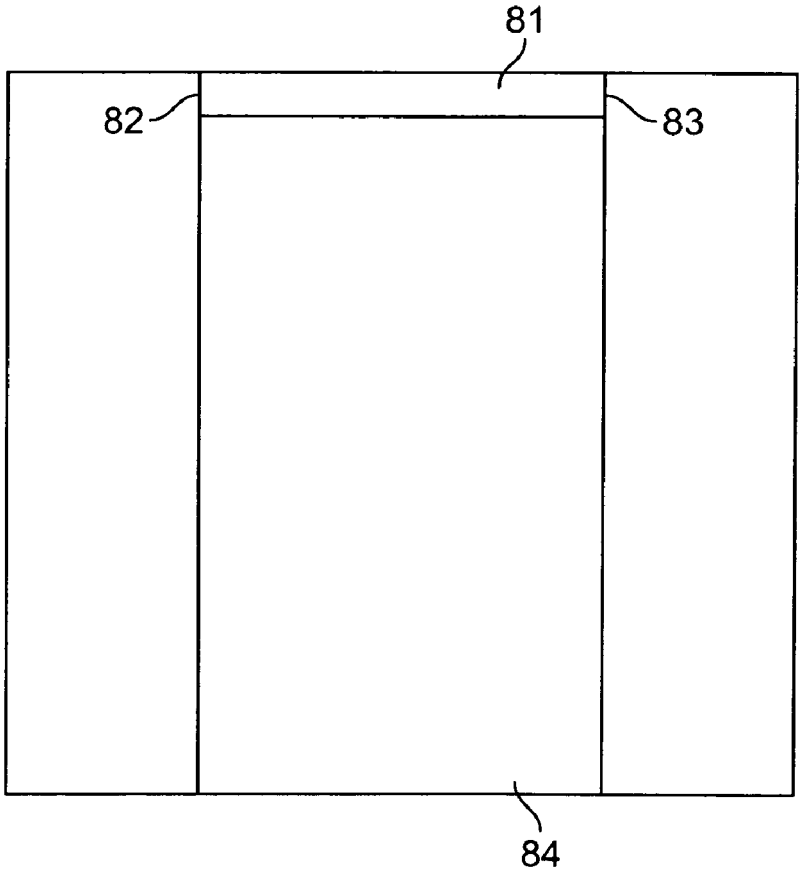
FIG. 8 is a bottom view of one open embodiment of the diaper changing pad of the present invention.

FIG. 8 shows the bottom view of an alternative embodiment of the present invention. A strap [81] is attached (by detachable clips, stitching, or other connection means known in the art) to the side edges [82, 83] of the middle panel [84] near the top (or, alternatively, bottom) edge of the middle panel [84]. Most preferably, the strap [81] is detachably attached with plastic clips. The strap [81] is preferably adjustable in length, or made of an elastic material. When the diaper changing pad is folded and rolled into the rolled position, the strap may be wrapped around the diameter of the rolled diaper changing pad to the opposite side of the diaper changing pad to secure the diaper changing pad in the rolled position. Most preferably, the strap [81] may be slung over the user's shoulder or around the user's waist in order to conveniently transport the rolled diaper changing pad. If the user transports the diaper changing pad around his or her waist, then the diaper changing pad can be unrolled on a surface in front of the user without removing the strap [81] from the user's waist, or, the strap can be removed (if attached with clips or another removable connection means known in the art). FIG. 6 shows a view of a strap [62] on one embodiment of the present invention in the rolled position. The strap [62] is attached to the rolled diaper changing pad with detachable clips [63].

Figure 7:
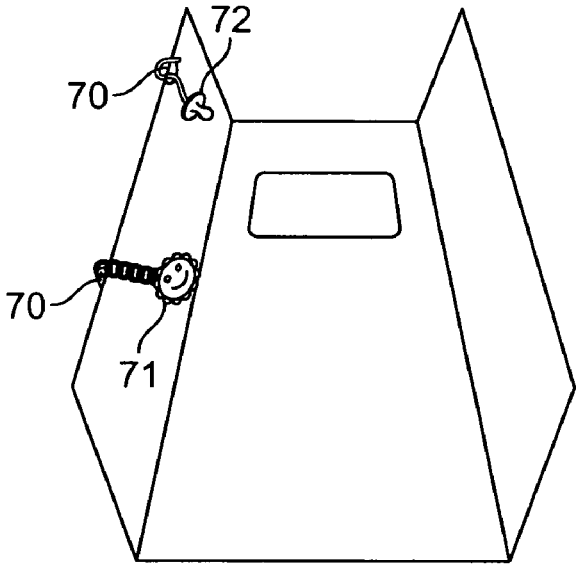
FIG. 7 is a perspective view of one embodiment of the present invention.

FIG. 7 shows another embodiment of the present invention further comprising accessories, such as a toy [71] and a pacifier [72]. Such accessories may be attached to hooks [70] on the mat, or by other attachment means such as straps, snaps, hook and loop fasteners, pockets, or other conventional means known in the art.

It is to be understood that numerous changes and modifications may be made to the preferred embodiment of this invention without departing from the scope and spirit of the invention as set forth in the appended claims.

What is claimed is:

1. A rollable diaper changing pad comprising a generally rectangular middle panel with two sides, a top and a bottom, the sides having a length of approximately 24" to 28", the top and the bottom having a width of approximately 10" to 12", the middle panel having a top surface and a bottom surface, which surfaces enclose a foam cushion, two generally rectangular side panels having inner and outer edges, the inner edges of each side panel attached to a side of the middle panel, the width of the side panels being about one half of the width of the middle panel, whereby when the side panels are folded over the middle panel, the outer edges of the side panels meet at the center of the middle panel, and a securing flap attached to the bottom surface of the middle panel, said flap comprising connectors adapted to maintain the pad in a rolled condition when the side panels are folded over the middle panel.

2. The diaper changing pad of claim 1 wherein the foam cushion comprises a body of memory foam.

3. The diaper changing pad of claim 2 wherein said body of memory foam is approximately ⅛"-½" thick.

4. The diaper changing pad of claim 2 wherein said body of memory foam comprises a water-resistant covering.

5. The diaper changing pad of claim 2 wherein said cushion further comprises a head rest having a top surface raised above a top surface of said body of memory foam.

6. The diaper changing pad of claim 5 wherein said head rest comprises a second body of memory foam.

7. The diaper changing pad of claim 6 wherein said body of memory foam is approximately ⅛"-½" thick and said second body of memory foam is approximately ⅛"-¼" thick.

8. The diaper changing pad of claim 5 wherein said head rest is a part of said body of memory foam.

9. The diaper changing pad of claim 8 wherein the top surface of the head rest slopes downward to the top surface of said body of memory foam and wherein the top surface of the head rest is raised no more than ¼" above the top surface of said body of memory foam.

10. The diaper changing pad of claim 1 wherein said cushion is attached to said middle panel between the top surface and the bottom surface of the middle panel.

11. The diaper changing pad of claim 10, wherein said cushion is removable from said middle panel.

12. The diaper changing pad of claim 1 wherein said bottom surface comprises an area of nonskid material.

13. The diaper changing pad of claim 1 further comprising a bag for holding the pad in the rolled position.

14. The diaper changing pad of claim 1 wherein the bag has pockets for accessories.

15. The diaper changing pad of claim 1 further comprising a strap for holding the pad in the rolled position.

16. The diaper changing pad of claim 1 further comprising at least one attached accessory.

17. The diaper changing pad of claim 16, wherein said accessory comprises a toy.

* * * * *